US009806443B1

(12) United States Patent
Thackston

(10) Patent No.: US 9,806,443 B1
(45) Date of Patent: Oct. 31, 2017

(54) PRESS-FIT CIRCUIT BOARD CONNECTOR

(71) Applicant: TYCO ELECTRONICS CORPORATION, Berwyn, PA (US)

(72) Inventor: Kevin Michael Thackston, York, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/353,209

(22) Filed: Nov. 16, 2016

Related U.S. Application Data

(63) Continuation-in-part of application No. 15/162,848, filed on May 24, 2016.

(51) Int. Cl.
*H01R 13/502* (2006.01)
*H01R 12/58* (2011.01)
*H01R 12/70* (2011.01)

(52) U.S. Cl.
CPC ..... *H01R 12/585* (2013.01); *H01R 12/7082* (2013.01)

(58) Field of Classification Search
CPC ..... H01R 13/46; H01R 12/724
USPC ..... 439/79, 80, 686, 701
See application file for complete search history.

(56) References Cited

U.S. PATENT DOCUMENTS 2,658,183 A * 11/1953 Klostermann ..... H01R 33/7664 174/50
4,482,937 A * 11/1984 Berg ..... H01R 12/716 361/789
4,904,212 A * 2/1990 Durbin ..... H01R 43/205 29/845
4,992,055 A * 2/1991 Brummans ..... H01R 24/62 439/676
5,006,080 A * 4/1991 Ichitsubo ..... H01R 31/06 439/631
5,045,977 A * 9/1991 Cesar ..... H01R 13/6585 361/725
5,064,389 A * 11/1991 Klein ..... H01R 31/06 439/651
5,137,462 A * 8/1992 Casey ..... H01R 31/00 439/160
5,236,376 A * 8/1993 Cohen ..... H01R 13/7197 333/185
5,575,690 A * 11/1996 Eaton ..... H01R 13/187 439/176
5,647,749 A * 7/1997 Atoh ..... H01R 12/725 439/686

(Continued)

*Primary Examiner* — Neil Abrams

(57) ABSTRACT

A press-fit circuit board connector used with different mating connection arrangement is provided including a housing having a front chamber and a rear chamber. A contact assembly is received in the rear chamber and includes a contact holder including a plurality of contact channels and contacts received in corresponding contact channels. Each contact has a mating terminal and a mounting terminal. The mating terminal extends into the front chamber for electrical connection with a mating connector in a mating direction along a mating axis. The mounting terminal has a compliant connecting pin configured for compliant mating with the mating terminal and a compliant mounting pin configured for press-fit mechanical and electrical connection to a circuit board in a pressing direction along a pressing axis generally perpendicular to the mating axis.

18 Claims, 10 Drawing Sheets

(56) References Cited

U.S. PATENT DOCUMENTS

| | | | | |
|---|---|---|---|---|
| 6,042,394 | A * | 3/2000 | Mitra | H01R 12/724 439/607.1 |
| 6,257,934 | B1 * | 7/2001 | Gong | H01R 13/7031 439/358 |
| 6,270,366 | B1 * | 8/2001 | Jeon | H01R 13/28 439/170 |
| 6,278,284 | B1 * | 8/2001 | Mori | G01R 1/0483 324/756.02 |
| 6,338,631 | B1 * | 1/2002 | Hashimoto | H01R 12/727 439/362 |
| 6,351,392 | B1 * | 2/2002 | Palaniappa | H01R 31/005 257/48 |
| 6,379,189 | B2 * | 4/2002 | Sakai | H01R 31/06 439/638 |
| 6,743,053 | B2 * | 6/2004 | Wu | H01R 13/506 439/357 |
| 7,094,109 | B2 * | 8/2006 | Chou | H01R 31/065 439/651 |
| 8,100,699 | B1 * | 1/2012 | Costello | H01R 12/7082 439/541.5 |
| 8,382,530 | B2 * | 2/2013 | Ando | H01R 43/24 439/701 |
| 2016/0190722 | A1 * | 6/2016 | Nagasawa | H01R 13/405 439/660 |

* cited by examiner

PRESS-FIT CIRCUIT BOARD CONNECTOR

CROSS REFERENCE TO RELATED APPLICATIONS

This application is a continuation in part of, and claims benefit to the filing date of, U.S. patent application Ser. No. 15/162,848, filed May 24, 2016, titled PRESS-FIT CIRCUIT BOARD, the subject matter of which is herein incorporated by reference in its entirety.

BACKGROUND OF THE INVENTION

The subject matter herein relates generally to circuit board connectors.

Electrical connectors provide communicative interfaces between electrical components where power and/or signals may be transmitted therethrough. For example, the electrical connectors may be used within telecommunication equipment, servers, and data storage or transport devices. Typically, electrical connectors are used in environments, such as in offices or homes, where the connectors are not subjected to constant shock, vibration, and/or extreme temperatures. However, in some applications, such as aerospace or military equipment, the electrical connector must be configured to withstand certain environmental conditions and still effectively transmit power and/or data signals.

In some applications, electrical connectors are terminated to circuit boards. The electrical connectors have solder tails that are soldered to the circuit board. Terminating the electrical connectors to the circuit board may be a time consuming and expensive process. For example, the electrical connector must be positioned relative to the circuit board and then the assembly is further processed to solder the solder tails to the circuit board. Furthermore, the circuit board interface may require that the contacts be arranged at a different pattern than the mating interface. For example, the circuit board may require particular spacing between the circuits for routing of the circuits.

Accordingly, there is a need for an electrical connector that offers alternative mounting to the circuit board to establish an electrical connection.

BRIEF DESCRIPTION OF THE INVENTION

In one embodiment, a press-fit circuit board connector is provided including a housing having a front and a rear with a front chamber at the front configured to receive a mating connector and a rear chamber at the rear. A contact assembly is received in the rear chamber of the housing. The contact assembly has a contact holder including a plurality of contact channels and contacts received in corresponding contact channels. Each contact has a mating terminal and a mounting terminal discrete from the corresponding mating terminal and mechanically and electrically connected to the corresponding mating terminal. The mating terminal extends between a front and a rear with the front extending into the front chamber of the housing for electrical connection with the mating connector in a mating direction along a mating axis. The mounting terminal extends between a front and a rear. The mounting terminal has a connecting pin at the front and a mounting pin at the rear. The connecting pin of the mounting terminal is compliant and configured for compliant mating with the rear of the mating terminal. The mounting pin of the mounting terminal is compliant and configured for press-fit mechanical and electrical connection to a circuit board in a pressing direction along a pressing axis generally perpendicular to the mating axis.

In another embodiment, a press-fit circuit board connector is provided including a housing having a front and a rear with a front chamber at the front configured to receive a mating connector and a rear chamber at the rear. A contact assembly is received in the rear chamber of the housing. The contact assembly has a contact holder including a plurality of contact channels and contacts received in corresponding contact channels. Each contact has a mating terminal and a mounting terminal discrete from the corresponding mating terminal and mechanically and electrically connected to the corresponding mating terminal. The mating terminal extends between a front and a rear and has a mating socket at the front extending into the front chamber of the housing for electrical connection with the mating connector. The mounting terminal extends between a front and a rear. The mounting terminal has a connecting pin at the front and a mounting pin at the rear. The connecting pin of the mounting terminal is compliant and configured for compliant mating with the rear of the mating terminal. The mounting pin of the mounting terminal is compliant and configured for press-fit mechanical and electrical connection to a circuit board.

In a further embodiment, a press-fit circuit board connector is provided including a housing having a front and a rear with a front chamber at the front configured to receive a mating connector and a rear chamber at the rear. A contact assembly is received in the rear chamber of the housing. The contact assembly has a contact holder including a plurality of contact channels and contacts received in corresponding contact channels. Each contact has a mating terminal and a mounting terminal discrete from the corresponding mating terminal and mechanically and electrically connected to the corresponding mating terminal. The mating terminal extends between a front and a rear with the front of the mating terminal extending into the front chamber of the housing for electrical connection with the mating connector and with a connecting socket at the rear. The mounting terminals are arranged in contact sets. The mounting terminals of each contact set are held by a corresponding insulator separate from other contact sets. The insulator of each contact set is coupled to the contact holder. Each mounting terminal extends between a front and a rear. The mounting terminal has a connecting pin at the front extending from the insulator and a mounting pin at the rear extending from the insulator. The connecting pin of the mounting terminal is compliant and configured for compliant mating with the rear of the mating terminal. The mounting pin of the mounting terminal is compliant and configured for press-fit mechanical and electrical connection to a circuit board.

DETAILED DESCRIPTION OF THE INVENTION

Figure 1:
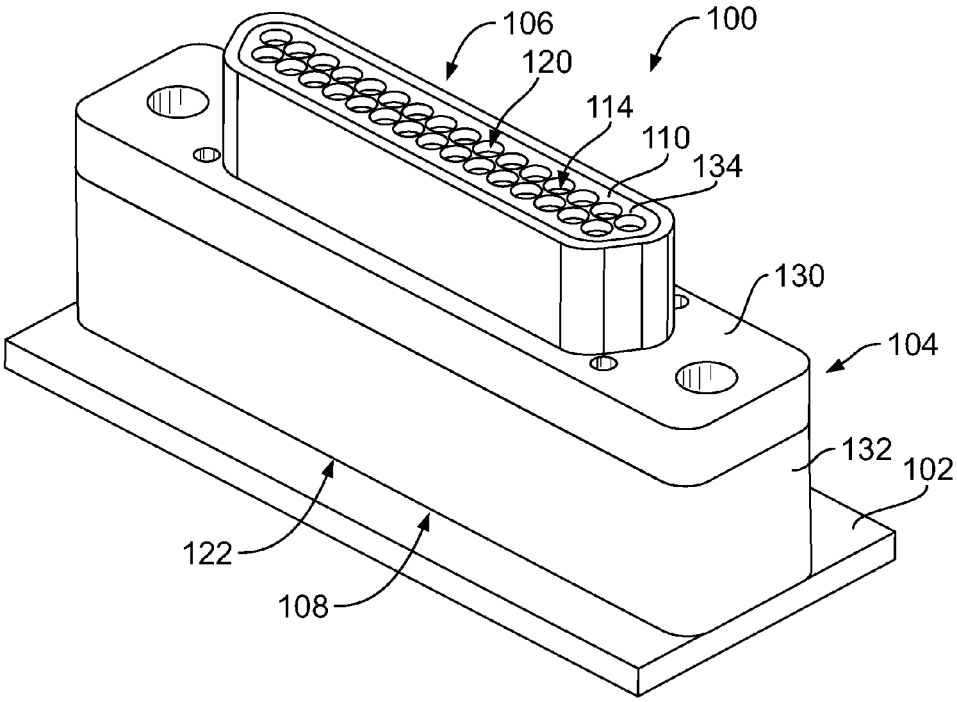
FIG. 1 is a perspective view of a press-fit circuit board connector formed in accordance with an exemplary embodiment.
Figure 2:
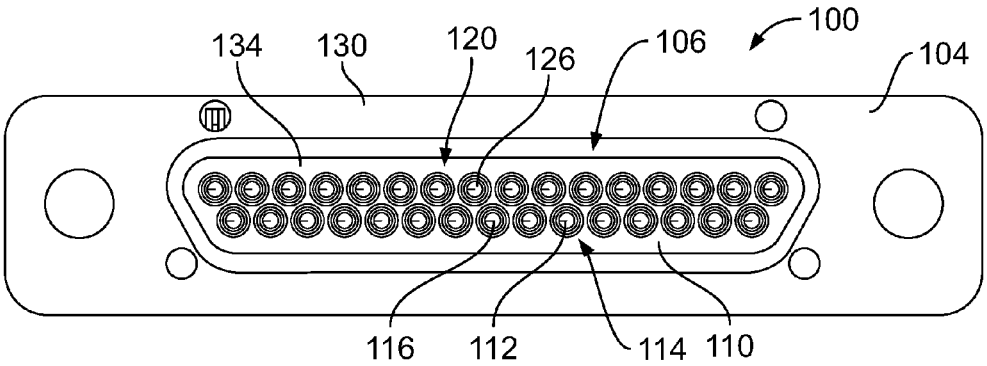
FIG. 2 is a top view of the circuit board connector.
Figure 3:
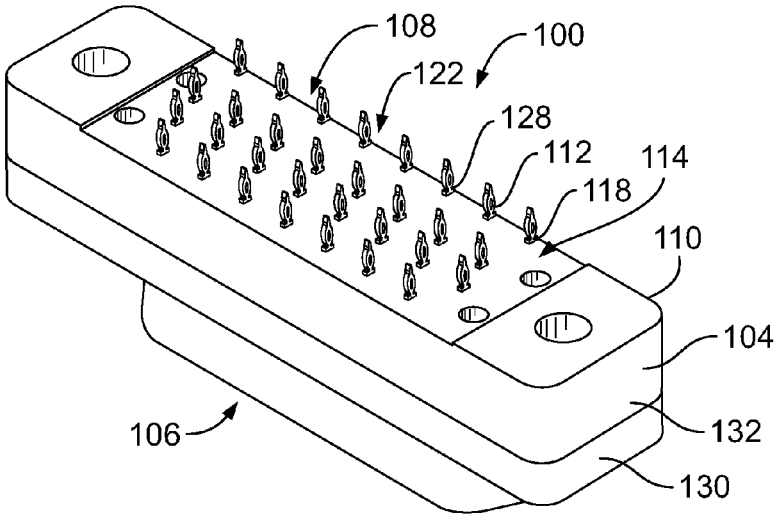
FIG. 3 is a rear perspective view of the circuit board connector showing compliant pins configured to be press-fit to a circuit board.
Figure 4:
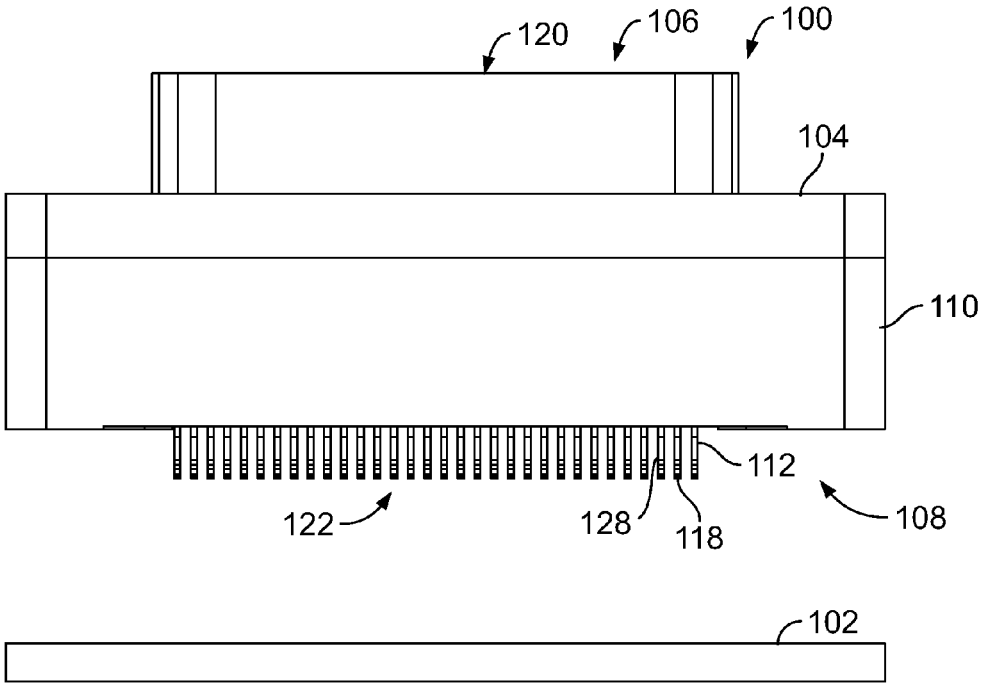
FIG. 4 is a side view of the circuit board connector poised for mounting to the circuit board.

FIG. 1 is a perspective view of a press-fit circuit board connector 100 formed in accordance with an exemplary embodiment mounted to a circuit board 102. FIG. 2 is a top view of the circuit board connector 100. FIG. 3 is a rear perspective view of the circuit board connector 100 showing compliant pins configured to be press-fit to the circuit board 102. FIG. 4 is a side view of the circuit board connector 100 poised for mounting to the circuit board 102 showing the compliant pins for press-fit mounting the circuit board connector 100 to the circuit board 102. The circuit board connector 100 is configured to be electrically connected with a mating connector, such as a press-fit circuit board connector 300 (shown in FIG. 19).

The circuit board connector 100 includes a housing 104 having a mating end 106 and a mounting end 108 opposite the mating end 106. The mating end 106 is configured for mating with the mating connector 300. The mounting end 108 is configured for mounting to the circuit board 102. In an exemplary embodiment, the circuit board connector 100 defines a vertical board-to-board connector configured to mate with the corresponding mating connector between two circuit boards that are oriented parallel to each other; however other types of connectors may be used in alternative embodiments, such as a right-angle connector. In the illustrated embodiment, the mating end 106 defines a plug configured to be mated with a receptacle connector; however, the mating end 106 may define a receptacle in alternative embodiments.

The housing 104 has a contact holder 110 holding a plurality of contacts 112 (FIG. 2). The contact holder 110 includes a plurality of contact channels 114 receiving corresponding contacts 112. In the illustrated embodiment, at the mating end 106 (FIG. 2), the contact channels 114 are cylindrical openings with the contacts 112 arranged therein. The contact channels 114 may receive corresponding mating contacts of the mating connector at the mating end 106. The contact channels 114, at the mounting end 108 (FIG. 3), may be slots or grooves formed in the contact holder 110 that hold the press-fit pin portions of the contacts 112 at the mounting end 108 for press-fit mounting to the circuit board 102.

The contacts 112 each have a mating pin 116 (FIG. 2) and a mounting pin 118 (FIG. 3) opposite the mating pin 116. Optionally, the contacts 112 may be single piece contacts wherein the mating pin 116 and the mounting pin 118 are stamped and formed from the same sheet of material. Alternatively, the contacts 112 may be multi-piece contacts, such as two piece contacts where the mating pin 116 and the mounting pin 118 are discrete from each other, manufactured from different sheets of material, that are mechanically and electrically connected together within the housing 104. For example, the two pieces may be press-fit together for mechanically and electrically connecting together. In other various embodiments, the two pieces may be soldered, welded or otherwise mechanically and electrically connected. In embodiments having multiple pieces for the pins 116, 118, the mating pin 116 and the mounting pin 118 may be manufactured from different sheets of material having different thicknesses.

In an exemplary embodiment, the mounting pins 118 are compliant and configured for press-fit mechanical and electrical connection to the circuit board 102. For example, the mounting pins 118 may be eye-of-the-needle pins. In an exemplary embodiment, the mating pins 116 are compliant and configured for compliant mating with corresponding mating contacts of the mating connector, such as socket contacts of the receptacle connector. In other various embodiments, the mating pins 116 may be configured to receive mating contacts. For example, the mating pins 116 may be female pins having sockets at the mating end to receive other male pins of the mating connector.

In an exemplary embodiment, the mating pins 116 are arranged at the mating end 106 to define a pin mating interface 120 having a first pattern and the mounting pins 118 are arranged at the mounting end 108 to define a pin mounting interface 122 having a second pattern different than the first pattern. For example, the mounting pins 118 at the pin mounting interface 122 have a pattern that is more spread out than the mating pins 116 at the pin mating interface 120. For example, the mounting pins 118 may be spread out to fit on the circuit board 102. Space may be needed on the circuit board 102 for plated through holes and/or for routing traces. The pin mating interface 120 may be designed to meet a particular standard, such as MIL-DTL-83513, or other standards, for intermateability, interchangeability and performance of a particular connector series. For example, in an exemplary embodiment, the circuit board connector 100 is a micro-D connector. In the illustrated embodiment, the mating pins 116 at the pin mating interface 120 are arranged in first and second rows, whereas the mounting pins 118 at the pin mounting interface 122 are arranged in more than two rows, such as third, fourth, fifth and sixth rows, allowing the mounting pins 118 to have a larger center line spacing between adjacent mounting pins 118 as compared to the center line spacing of the mating pins 116. Optionally, the mounting pins 118 at the pin mounting interface 122 are arranged in triangular groups with mounting pins 118 in the third and fourth rows forming triangular groups and with mounting pins 118 in the fifth and sixth rows defining triangular groups. In other various embodiments, the pin mating interface 120 may have more than two rows, such as four rows and the pin mounting interface 122 may have more than four rows, such as six rows. In other various embodiments, the mating and mounting interfaces 120, 122 may have the same pattern and/or spacing of pins, such as a 0.05" triangular grid at both ends.

Optionally, the housing 104 and/or the contact holder 110 may be multi-piece structures. For example, the housing 104 may include a front shell 130 and a rear holder 132. The rear holder 132 may form part of the contact holder 110. The front shell 130 holds an insulator 134 forming part of the contact holder 110. Optionally, the front shell 130 may be metal and the insulator 134 may be plastic. Optionally, the rear holder 132 may be plastic or another dielectric material. The rear holder 132 may be metal and may hold an insulator therein, similar to the insulator 134. The front shell 130 may be secured to the rear holder 132 using adhesive, epoxy, mechanical fasteners, or other means. Providing multi-piece structures allows for different types of assembly of the circuit board connector 100, such as the use of multi-piece contacts 112.

In an exemplary embodiment, the contacts 112 are multi-piece contacts including a mating terminal 126 at the mating end 106 and a mounting terminal 128 at the mounting end 108. The mating terminal 126 defines the mating pin 116. The mounting terminal 128 defines the mounting pin 118. The mounting terminals 128 are discrete from the mating terminals 126 and are mechanically and electrically connected to the corresponding mating terminals 126 within the housing 104.

Figure 5:
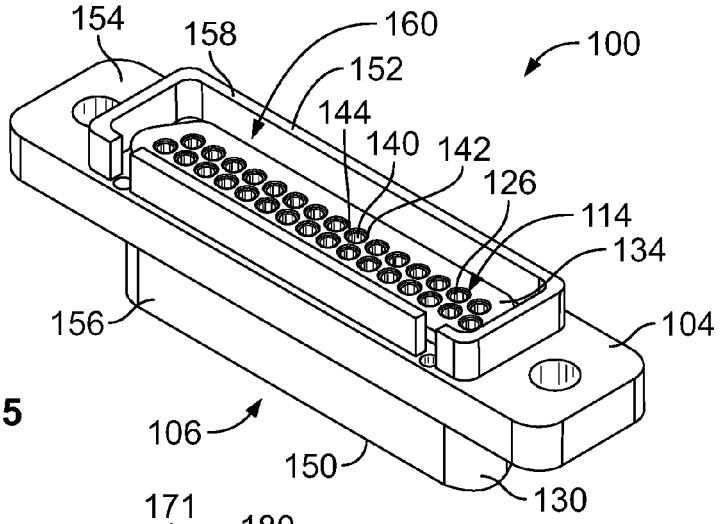
FIG. 5 is a rear perspective view of a portion of the circuit board connector in accordance with an exemplary embodiment.

FIG. 5 is a rear perspective view of a portion of the circuit board connector 100 showing the front shell 130, the insulator 134 and the mating terminals 126. The insulator 134 is received in the front shell 130. The insulator 134 includes the contact channels 114 and holds the mating terminals 126 in corresponding contact channels 114. Each mating terminal 126 includes a barrel-shaped base 140 at a rear 142 of the mating terminal 126. The rear 142 is opposite the mating pin 116 (shown in FIG. 2). The base 140 is configured to receive a portion of the mounting terminal 128 (shown in FIG. 3). In an exemplary embodiment, the mating terminals 126 are stamped and formed into the barrel shape. The mating terminals 126 include a seam 144 extending the length of the mating terminals 126 between the rear 142 and the front opposite the rear 142. For example, the mating terminal 126 may be stamped and formed into the barrel shape from a sheet of material having a first thickness. The thickness of the mating terminal 126 may be different than the thickness of the mounting terminal 128.

The front shell 130 extends between a front 150 and a rear 152. The front shell 130 includes a flange 154 between the front 150 and the rear 152. The flange 154 may have mounting openings for securing the front shell 130 to the rear holder 132 (shown in FIG. 1) and/or the circuit board 102 (shown in FIG. 1). The front shell 130 includes a tongue 156 extending forward of the flange 154. The tongue 156 extends to the front 150 and defines the mating end 106 of the housing 104. The front shell 130 includes a rim 158 extending from the flange 154 to the rear 152. The rim 158 surrounds a cavity 160. The insulator 134 is received in the cavity 160. The rim 158 is configured to be coupled to the rear holder 132 (shown in FIG. 1). In an exemplary embodiment, the mating terminals 126 may be pre-assembled into the insulator 134 prior to coupling the front shell 130 to the rear holder 132.

Figure 6:
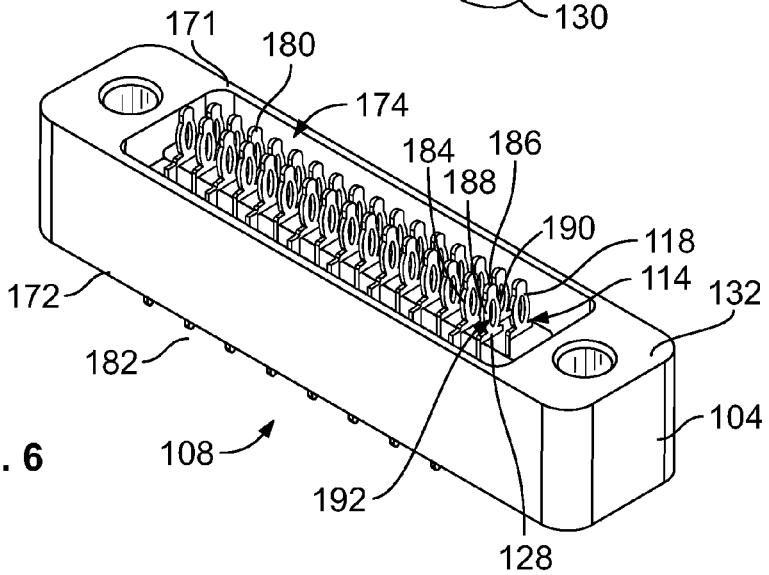
FIG. 6 is a front perspective view of a portion of the circuit board connector in accordance with an exemplary embodiment.

FIG. 6 is a front perspective view of the rear holder 132 in accordance with an exemplary embodiment. The rear holder 132 extends between a front 170 and a rear 172. The rear holder 132 includes a cavity 174 configured to receive a portion of the front shell 130. For example, the cavity 174 may be sized and shaped to receive the rim 158 (shown in FIG. 5) of the front shell 130. The rear holder 132 includes portions of the contact channels 114 that hold the mounting terminals 128. The mounting terminals 128 are arranged at the front 170 for mating with the mating terminals 126 (shown in FIG. 5) when the front shell 130 is coupled to the rear holder 132. The mounting terminals 128 are arranged at the rear 172 for mounting to the circuit board 102 (shown in FIG. 1).

The mounting terminals 128 each extend between a front 180 and a rear 182. The mounting pin 118 is provided at the rear 182 of the mounting terminal 128. In an exemplary embodiment, the mounting terminal 128 includes a connecting pin 184 at the front 180. The connecting pin 184 is compliant and configured for a press-fit mechanical and electrical connection to the mating terminal 126. In the illustrated embodiment, the connecting pin 184 is an eye-of-the-needle pin configured to be plugged into the base 140 (shown in FIG. 5) at the rear 142 of the mating terminal 126. In an exemplary embodiment, the mounting terminal 128 is stamped and formed to include the eye-of-the-needle shaped connecting pin 184 at the front 180 and the eye-of-the-needle shaped mounting pin 118 at the rear 182. Optionally, the connecting pin 184 may be arranged in the first pattern corresponding to the arrangement of the mating terminals 126, such as along two linear rows, whereas the mounting pins 118 are arranged in the second pattern, such as the triangular groups along multiple rows at the mounting end 108 of the housing 104.

Each connecting pin 184, in the illustrated embodiment, includes a compliant portion extending to a tip 186. The compliant portion includes opposing first and second legs 188, 190 surrounding an opening 192. The legs 188, 190 may be compressed inward into the opening 192 when the connecting pin 184 is press-fit into the base 140 of the mating terminal 126. The legs 188, 190 may be spring biased outward against the mating terminal 126 after the legs 188, 190 are deflected.

Figure 7:
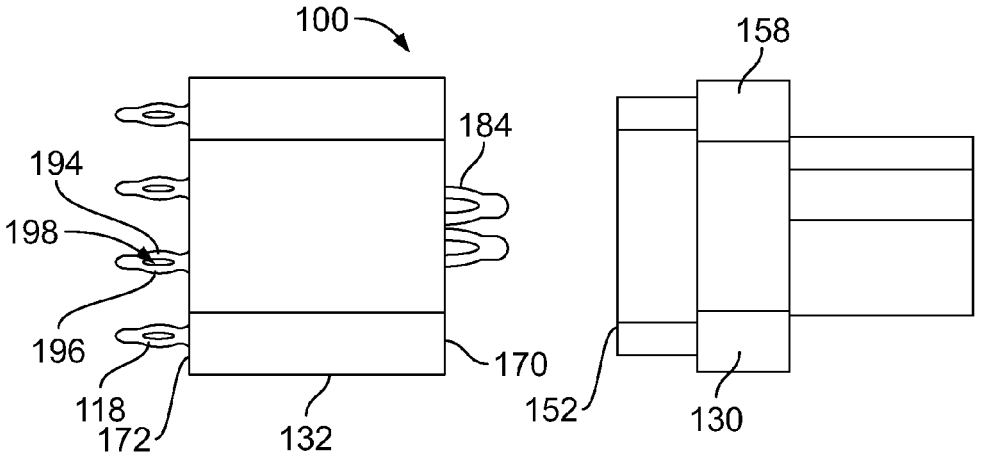
FIG. 7 is a side view of the circuit board connector in accordance with an exemplary embodiment.

FIG. 7 is a side view of the circuit board connector 100 showing the rear holder 132 poised for coupling to the front shell 130. The front 170 of the rear holder 132 faces the rear 152 of the front shell 130. The rim 158 of the front shell 130 is configured to be received in the rear holder 132. The connecting pins 184 are configured to be mated with corresponding mating terminals 126 (shown in FIG. 5). The mounting pins 118 extend rearward from the rear 172 of the rear holder 132 and are configured to be press-fit into the circuit board 102 (shown in FIG. 1). In an exemplary embodiment, the mounting pins 118 are eye-of-the-needle pins. Each mounting pin 118 includes a compliant portion having first and second opposing legs 194, 196 on opposite sides of an opening 198. The legs 194, 196 are configured to be deflected inward into the opening 198 when press-fit in plated vias of the circuit board 102.

Figure 8:
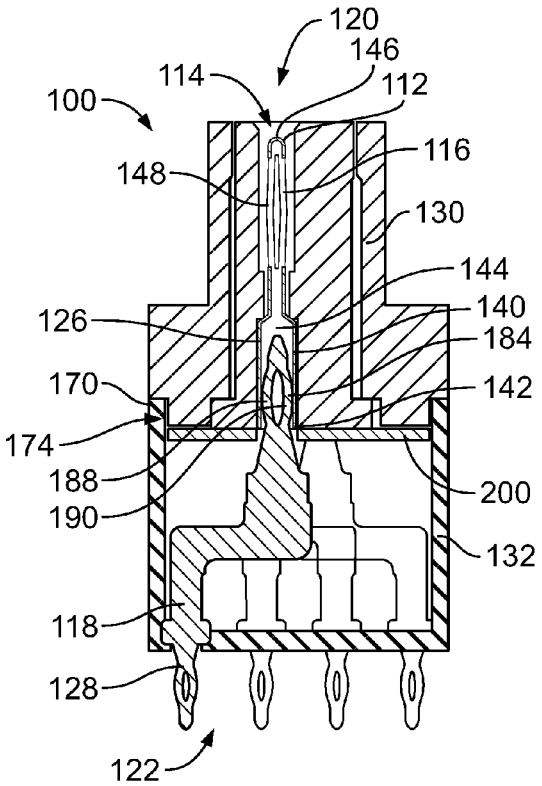
FIG. 8 is a cross-sectional view of the circuit board connector in accordance with an exemplary embodiment.
Figure 9:
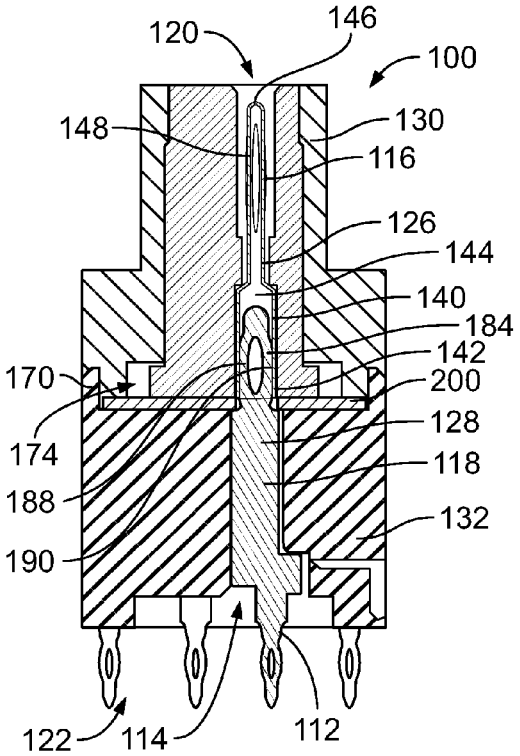
FIG. 9 is a cross-sectional view of the circuit board connector in accordance with an exemplary embodiment.

FIG. 8 is a cross-sectional view of the circuit board connector 100 in accordance with an exemplary embodiment. FIG. 9 is a cross-sectional view of the circuit board connector 100 in accordance with an exemplary embodiment. The front shell 130 is shown coupled to the rear holder 132. The contacts 112 are shown received in corresponding contact channels 114. In the illustrated embodiment, the contacts 112 are two-piece contacts having the mating terminal 126 and the mounting terminal 128. In an exemplary embodiment, the rear holder 132 includes a heat reflowable polymer layer 200 received in the cavity 174 near the front 170. The heat reflowable polymer layer 200 is used to secure the contacts 112 in the contact channels 114. The heat reflowable polymer layer 200 may be used to secure the front shell 130 to the rear holder 132. The heat reflowable polymer layer 200 may provide a seal between the front shell 130 and the rear holder 132.

The mating terminals 126 are received in the front shell 130 and are configured for mating with socket contacts of the mating connector. The mating pin 116 is provided at a front 146 of the mating terminal 126 and is configured to be mated with the socket contact. In an exemplary embodiment, the mating terminal 126 includes compliant beams 148 at the mating pin 116. The compliant beams 148 are bowed outward for connection to the socket contact when mated with the socket contact. The compliant beams 148 are deflectable and are configured to be spring biased against the socket contact when mated thereto. The compliant beams 148 are stamped and formed with the barrel shaped base 140 as a unitary structure with the base 140.

The mating terminal 126 includes the seam 144 extending the length between the front 146 and the rear 142. In an exemplary embodiment, the base 140 is open at the rear 142 to receive the connecting pin 184 of the mounting terminal 128. In an exemplary embodiment, the mating terminal 126 is oriented in the contact channel 114 such that the seam 144 is offset approximately 90° relative to the eye-of-the-needle shaped connecting pin 184. As such, the points where the first and second legs 188, 190 of the connecting pin 184 engage the base 140 are both offset from the seam 144 (e.g., approximately 90°). The compliant portion of the connecting pin 184 is compressed within the base 140 such that the legs 188, 190 press outward against the base 140 to ensure electrical connection between the mounting terminal 128 and the mating terminal 126. Optionally, the connecting pin 184 may press the base 140 outward, such as at the seam 144, such that the barrel shaped base 140 provides an inward biasing force against the connecting pin 184.

In an exemplary embodiment, the mounting terminals 128 transition between the connecting pin 184 and the mounting pin 118. Such transition spaces the mounting pins 118 apart from each other for mounting to the circuit board 102 (shown in FIG. 1). Optionally, different types of mounting terminals 128 may be provided. For example, interior mounting terminals 128 may have the mounting pins 118 approximately aligned with the connecting pins 184, whereas exterior mounting terminals 128 may have the mounting pins 118 shifted outward and offset with respect to the connecting pins 184. The transition of the mounting terminals 128 between the connecting pin 184 and the mounting pin 118 spaces the contacts 112 out at the pin mounting interface 122, as compared to the pin mating interface 120.

Figure 10:
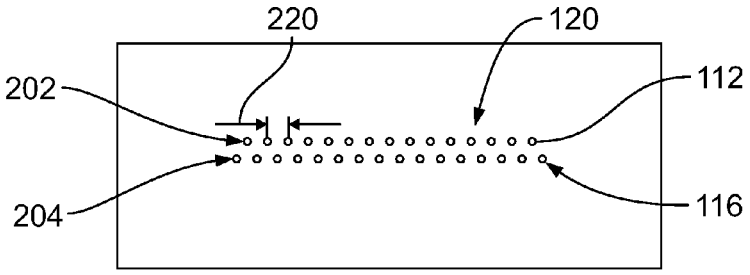
FIG. 10 shows an exemplary pin mating interface of the circuit board connector.
Figure 11:
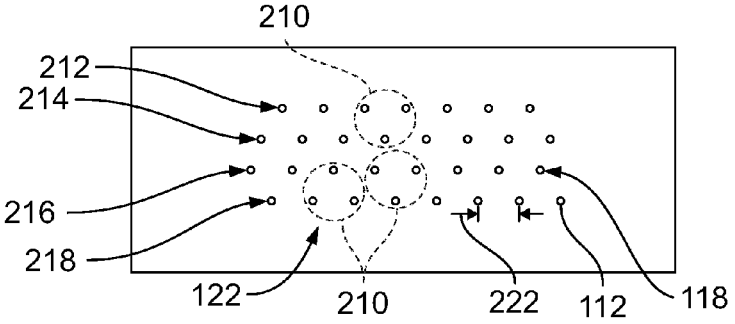
FIG. 11 shows an exemplary pin mounting interface of the circuit board connector.

FIG. 10 shows an exemplary pin mating interface 120 and FIG. 11 shows an exemplary pin mounting interface 122. The pin mating interface 120 has the contacts 112 arranged in a first pattern and the pin mounting interface 122 has the contacts 112 arranged in a second pattern different than the first pattern. The first pattern arranges the mating pins 116 of the contacts 112 in two rows and the second pattern arranged the mounting pins 118 in more than two rows. For example, the circuit board connector 100 may include upper contacts (FIG. 8) and lower contacts (FIG. 9). The upper contacts are arranged towards an upper side of the circuit board connector 100 whereas the lower contacts are arranged toward a lower side of the circuit board connector 100.

In the illustrated embodiment, the upper contacts are arranged linearly in a first row 202 at the pin mating interface 120 and the lower contacts are arranged linearly in a second row 204 at the pin mating interface 120. The upper and lower contacts are arranged in triangular groups 210 at the pin mounting interface 122. The upper contacts are arranged in the triangular groups 210 along third and fourth rows 212, 214 at the pin mounting interface 122 and the lower contacts are arranged in the triangular groups 210 along fifth and sixth rows 216, 218 at the pin mounting interface 122.

In the illustrated embodiment, the mating pins 116 at the pin mating interface 120 have a first center line spacing 220 between adjacent mating pins 116 within the same row 202 or 204. The mounting pins 118 have a second center line spacing 222 between adjacent mounting pins 118 within the same rows 212, 214, 216 or 218 and may have the same centerline spacing between each of the mounting pins 118 within the triangular group. The second center line spacing 222 is greater than the first center line spacing 220, which may provide additional spacing for routing conductors within the circuit board 102 (shown in FIG. 1).

Figure 12:
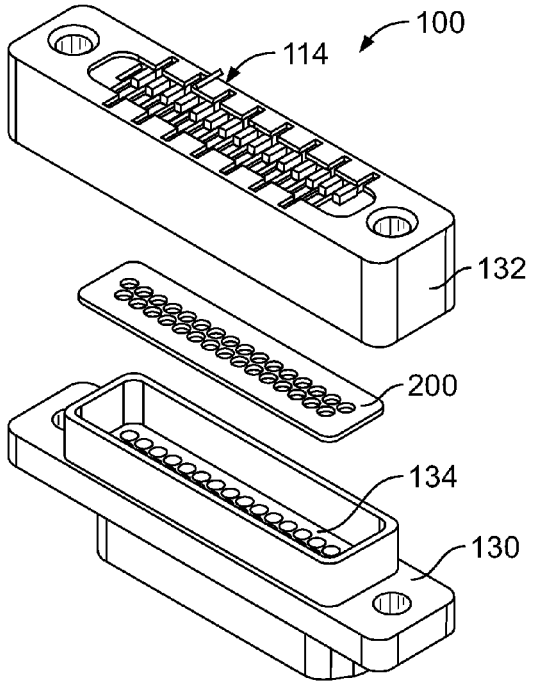
FIG. 12 is an exploded, rear perspective view of the circuit board connector in accordance with an exemplary embodiment.

FIG. 12 is an exploded, rear perspective view of the circuit board connector 100 in accordance with an exemplary embodiment. FIG. 12 shows the heat reflowable polymer layer 200 positioned between the rear holder 132 and the insulator 134 in the front shell 130. The contact channels 114 are also shown in FIG. 12. In an exemplary embodiment, the heat reflowable polymer layer 200 includes openings configured to be aligned with the contact channels 114 to receive the contacts 112 (shown in FIG. 13).

Figure 13:
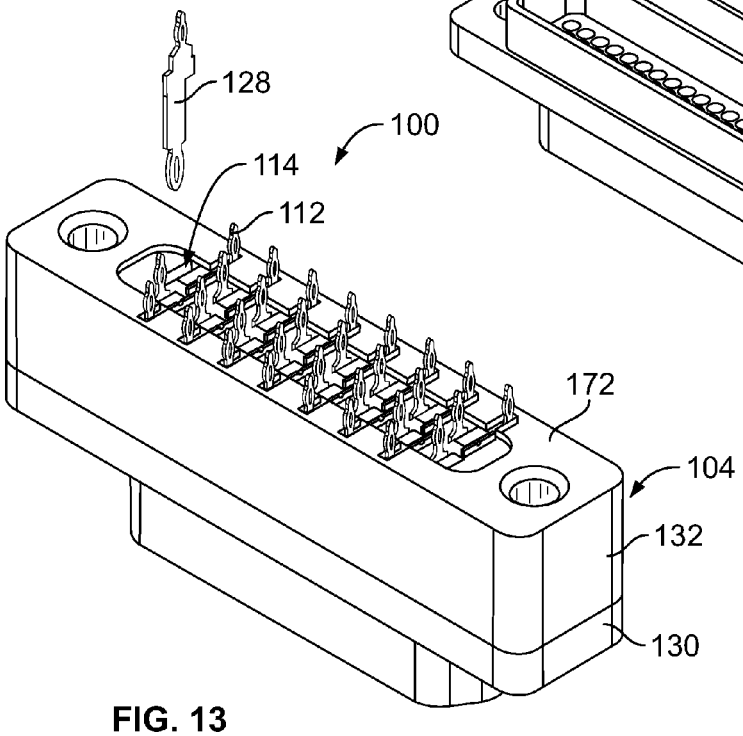
FIG. 13 is a rear perspective view of the circuit board connector in accordance with an exemplary embodiment.

FIG. 13 is a rear perspective view of the circuit board connector 100 in accordance with an exemplary embodiment. FIG. 13 illustrates one of the mounting terminals 128 of the contacts 112 poised for loading into the corresponding contact channel 114 at the rear 172 of the rear holder 132. In an exemplary embodiment, the mounting terminals 128 of the contacts 112 may be loaded into the housing 104 after the front shell 130 is coupled to the rear holder 132. For example, the mounting terminals 128 may be stitched into the contact channels 114. As the mounting terminals 128 are loaded into the rear holder 132, the mounting terminals 128 are mechanically and electrically connected to the mating terminals 126 (shown in FIG. 2).

Figure 14:
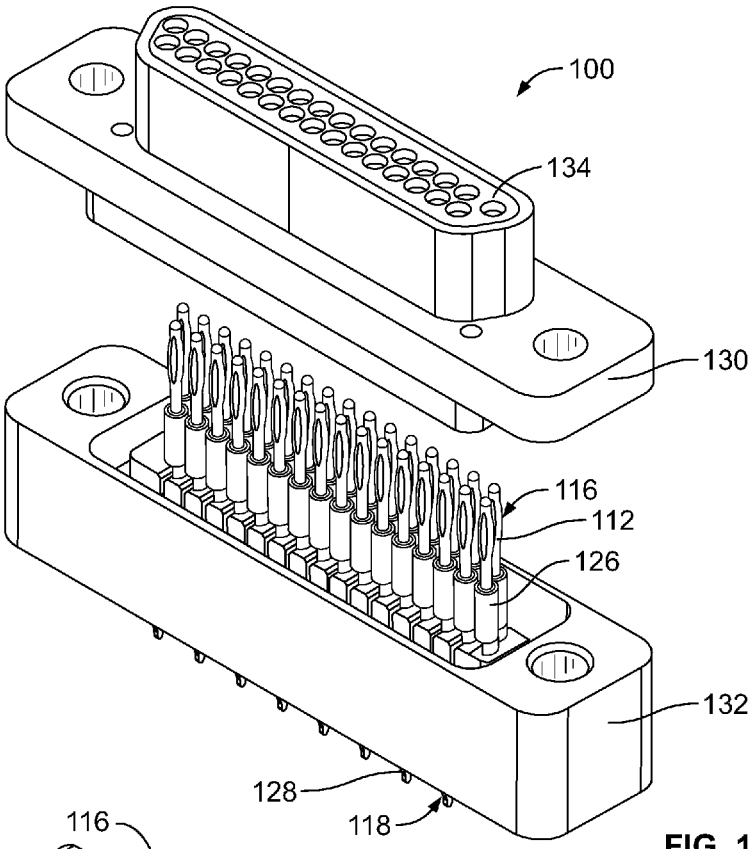
FIG. 14 is an exploded, front perspective view of the circuit board connector in accordance with an exemplary embodiment.

FIG. 14 is an exploded, front perspective view of the circuit board connector 100 in accordance with an exemplary embodiment. FIG. 14 shows the contacts 112 preloaded into the rear holder 132 and the front shell 130 and insulator 134 configured to be loaded over the contacts 112. For example, the mounting terminals 128 are arranged in the rear holder 132 and the mating terminals 126 extend from the mounting terminals 128 forward of the rear holder 132. Optionally, the mating terminals 126 may be discrete from the mounting terminals 128 and coupled thereto. Alternatively, the mating terminals 126 may be integral with the mounting terminals 128 as a single piece contact body. For example, both the mating pin 116 and the mounting pin 118 may be stamped and formed from the same sheet of material.

Figure 15:
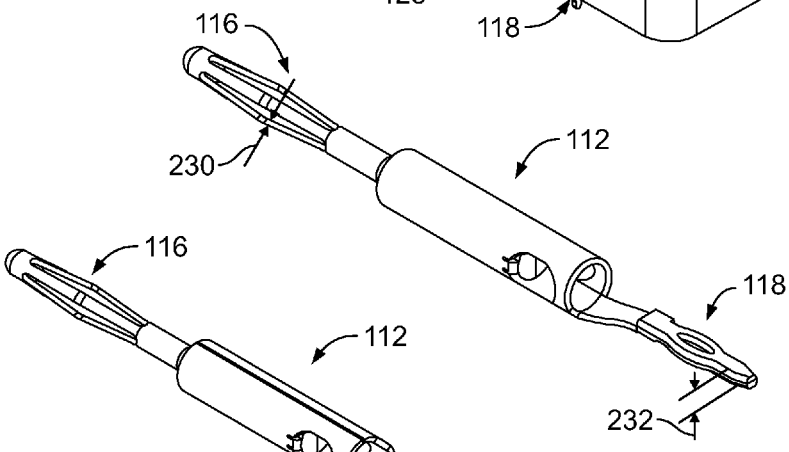
FIG. 15 is a perspective view of a contact of the circuit board connector formed in accordance with an exemplary embodiment.

FIG. 15 is a perspective view of a contact 112 formed in accordance with an exemplary embodiment. The contact 112 shown in FIG. 15 is a single piece contact having the mating pin 116 and the mounting pin 118 stamped and formed from the same sheet of material. In an exemplary embodiment, the body of the contact 112 at the mating pin 116 has a first thickness 230 and the mounting pin 118 has a second thickness 232 greater than the first thickness 230. For example, the body of the contact 112 at the mounting pin 118 is folded over to double the thickness at the mounting pin 118. In an exemplary embodiment, the sheet of material from which the contact 112 is stamped is 0.004", making the material easy to work with and form the barrel shape and pin structure at the mating pin 116, while the mounting pin 118 is 0.008", making the mounting pin 118 more robust and strong enough for press-fit mounting to the circuit board 102 (shown in FIG. 1). By doubling the thickness of the mounting pin 118, the mounting pin 118 is less susceptible to buckling during press-fit mounting to the circuit board 102.

In alternative embodiments, other processes may be used to provide different thicknesses for the pins 116, 118. For example, the body of the contact 112 at the mating pin 116 may be skived or milled to reduce the first thickness, leaving the mounting pin 118 at the stock thickness. For example, the sheet of material used to form the contact 112 may have a thickness of 0.006" and material is removed from the mating pin 116 to provide a first thickness of 0.004".

Figure 16:
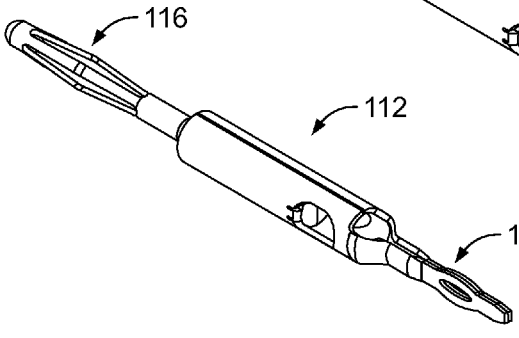
FIG. 16 is a perspective view of a contact of the circuit board connector formed in accordance with an exemplary embodiment.

FIG. 16 is a perspective view of a contact 112 formed in accordance with an exemplary embodiment. The contact 112 shown in FIG. 16 is a single piece contact having the mating pin 116 and the mounting pin 118 stamped and formed from the same sheet of material. The ends of the body are arranged back-to-back at the mounting pin 118 to provide a double thickness mounting pin 118.

Figure 17:
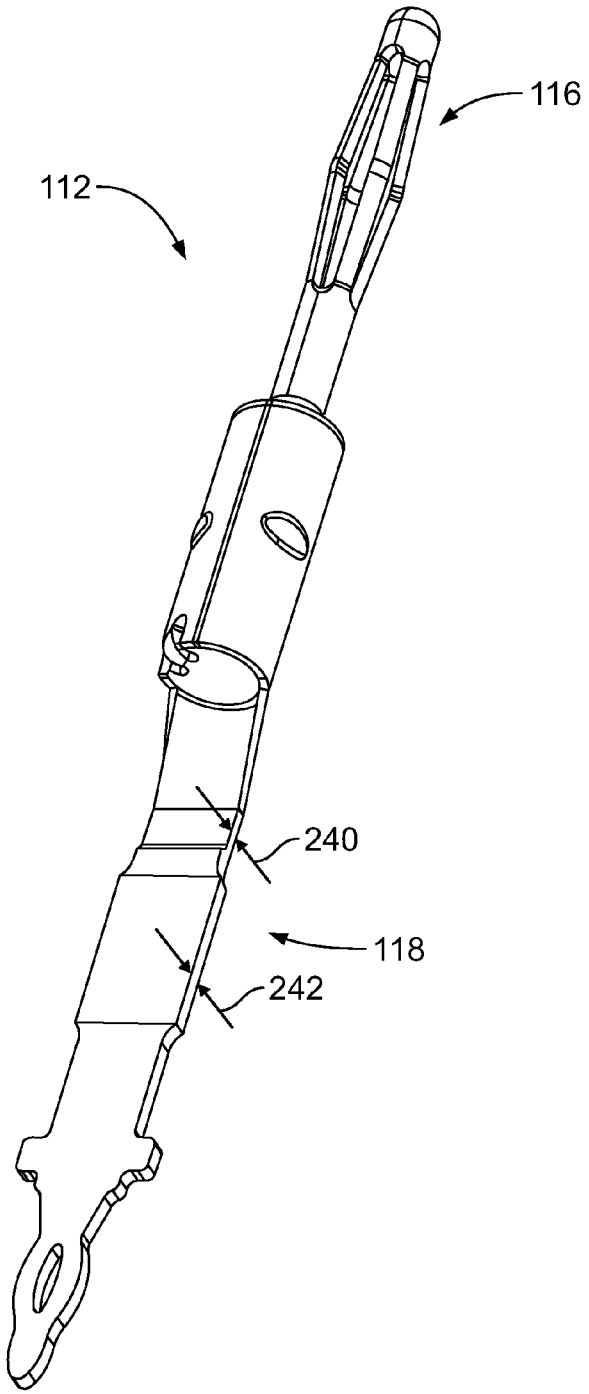
FIG. 17 is a perspective view of a contact of the circuit board connector formed in accordance with an exemplary embodiment.
Figure 18:
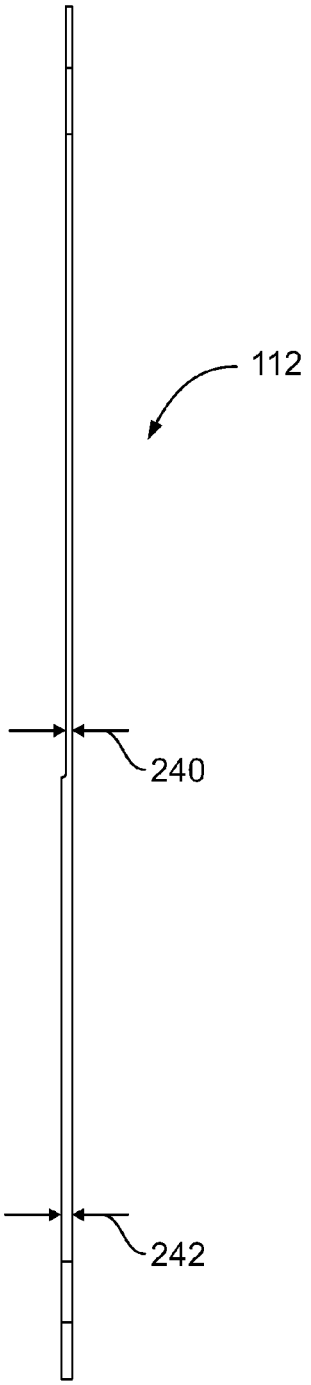
FIG. 18 is a side view of the contact shown in FIG. 17 in a pre-formed state.

FIG. 17 is a perspective view of a contact 112 formed in accordance with an exemplary embodiment. FIG. 18 is a side view of the contact 112 in a pre-formed state. The contact 112 shown in FIG. 17 is a single piece contact having the mating pin 116 and the mounting pin 118 stamped and formed from the same sheet of material. In an exemplary embodiment, the body of the contact 112 at the mating pin 116 has a first thickness 240 and the mounting pin 118 has a second thickness 242 greater than the first thickness 240. For example, the body of the contact 112 at the mating pin 116 is skived to reduce the thickness at the mating pin 116. In an exemplary embodiment, the sheet of material from which the contact 112 is stamped is 0.008" and the contact 112 in the mating pin 116 area is skived to 0.004", making the material easy to work with and form the barrel shape and pin structure at the mating pin 116. The mounting pin 118 is thicker making the mounting pin 118 more robust and strong enough for press-fit mounting to the circuit board 102 (shown in FIG. 1). The material may have other thicknesses in alternative embodiments.

Figure 19:
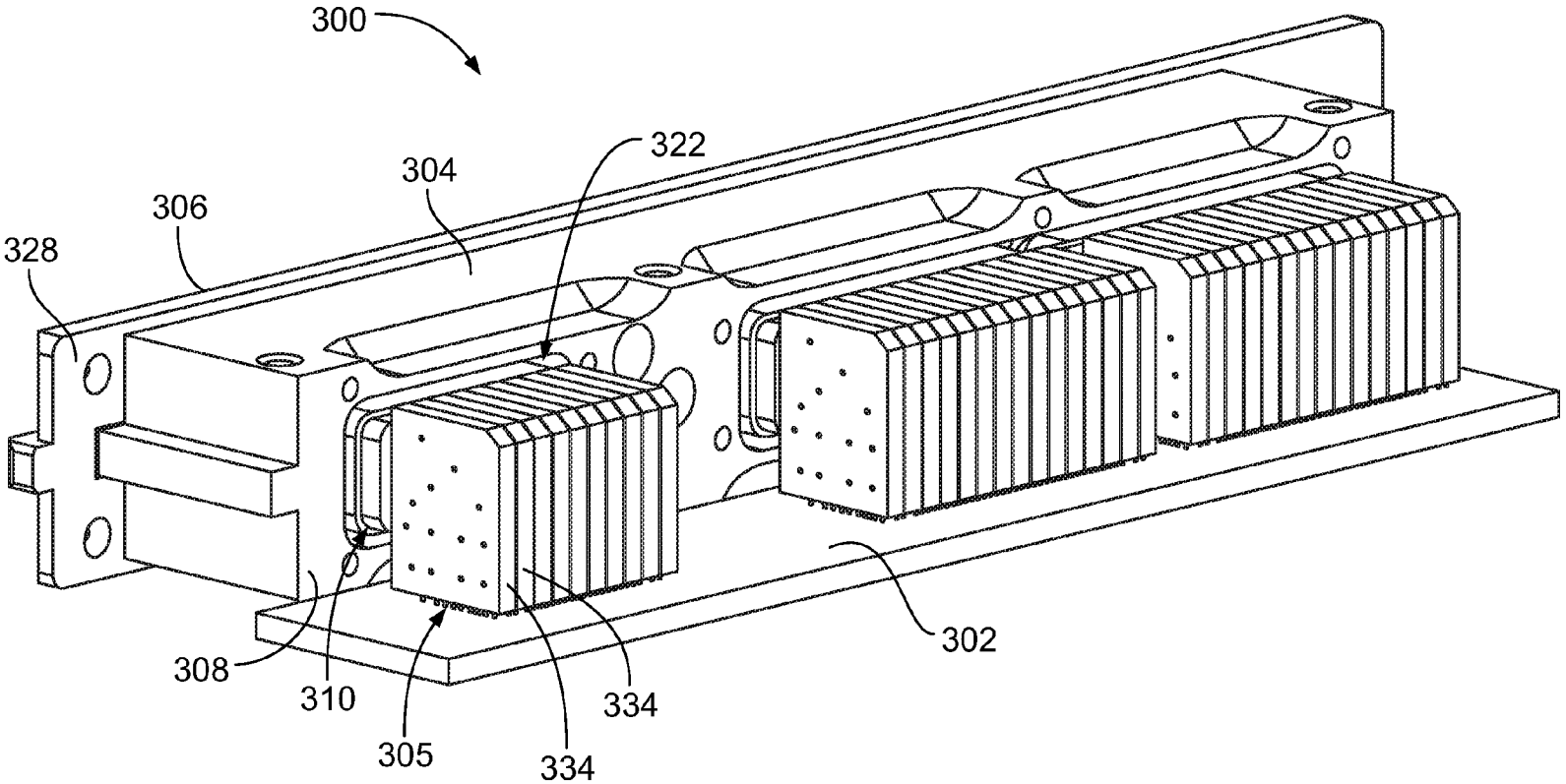
FIG. 19 is a rear perspective view of a press-fit circuit board connector formed in accordance with an exemplary embodiment mounted to a circuit board.
Figure 20:
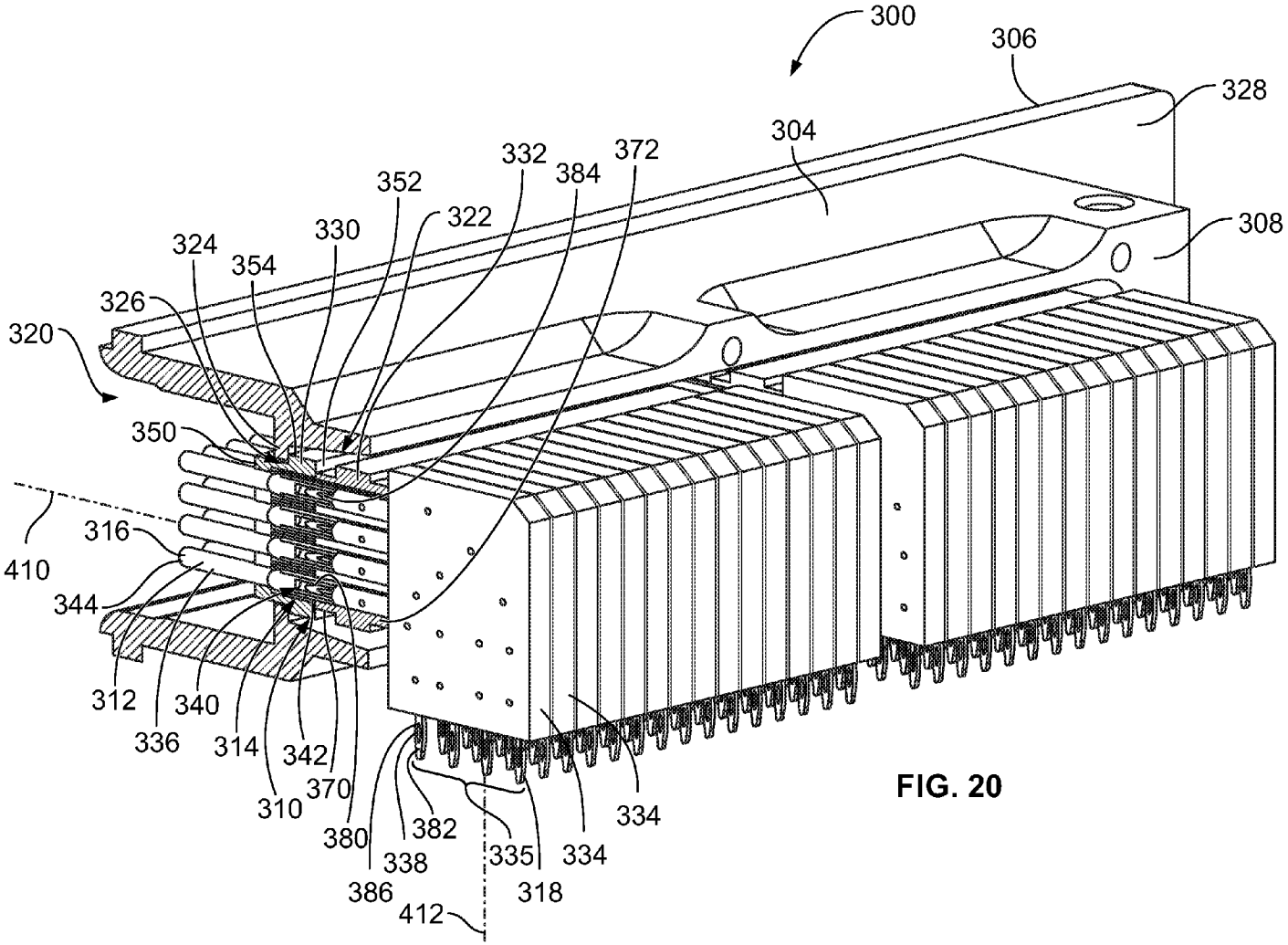
FIG. 20 is a partial sectional view of the circuit board connector.

FIG. 19 is a rear perspective view of a press-fit circuit board connector 300 formed in accordance with an exemplary embodiment mounted to a circuit board 302. FIG. 20 is a partial sectional view of the circuit board connector 300. The circuit board connector 300 is configured to be electrically connected with a mating connector, such as the press-fit circuit board connector 100 (shown in FIG. 1).

The circuit board connector 300 includes a housing 304 used to hold a contact assembly 305. The housing 304 has a front 306 and a rear 308 opposite the front 306. The front 306 is configured for mating with the mating connector 100 and may define a mating end 306. The rear 308 may be mounted to the circuit board 302. In an exemplary embodiment, the circuit board connector 300 defines a right angle or 90° board-to-board connector configured to mate with the corresponding mating connector 100 to make an electrical connection between two circuit boards that are oriented perpendicular to each other; however other types of connectors may be used in alternative embodiments, such as a vertical connector. In the illustrated embodiment, the front 306 defines a socket configured to receive the mating connector 100; however, the front 306 may define a plug in alternative embodiments.

The contact assembly 305 has a contact holder 310 holding a plurality of contacts 312. The contact holder 310 includes a plurality of contact channels 314 receiving corresponding contacts 312. In the illustrated embodiment, the contact channels 314 may be cylindrical openings with the contacts 312 arranged therein. The contacts 312 may emerge from the contact channels 314, such as for mating with the mating connector 100 and/or for mounting to the circuit board 302.

The contacts 312 each have a mating portion 316 and a mounting portion 318 opposite the mating portion 316. Optionally, the contacts 312 may be single piece contacts wherein the mating portion 316 and the mounting portion 318 are stamped and formed from the same sheet of material. Alternatively, the contacts 312 may be multi-piece contacts, such as two piece contacts where the mating portion 316 and the mounting portion 318 are discrete from each other, manufactured from different sheets of material, that are mechanically and electrically connected together within the housing 304. For example, the two pieces may be press-fit together for mechanically and electrically connecting together. In other various embodiments, the two pieces may be soldered, welded or otherwise mechanically and electrically connected. In embodiments having multiple pieces, the mating portion 316 and the mounting portion 318 may be manufactured from different sheets of material having different thicknesses.

In an exemplary embodiment, the mounting portions 318 are compliant and configured for press-fit mechanical and electrical connection to the circuit board 302. For example, the mounting portions 318 may include eye-of-the-needle pins. In an exemplary embodiment, the mating portions 316 are tubes or sockets configured for receiving mating pins of the mating connector 100. In other various embodiments, the mating portions 316 may be pins configured for plugging mating with corresponding mating contacts of the mating connector 100. For example, the mating portions 316 may be male pins that may be plugged into sockets of the mating connector.

The housing 304 has a front chamber 320 and a rear chamber 322 with a separating wall 324 therebetween. The separating wall 324 includes openings 326 that receive portions of the contact assembly 305. For example, a portion of the contact holder 310 may extend through the opening 326. The contacts 312 may pass through the opening 326 such that the contacts 312 are arranged in the front chamber 320 and the rear chamber 322. For example, the mating portions 316 may extend into the front chamber 320 for mating with the mating contacts of the mating connector 100. The contacts 312 may extend rearward from the rear chamber 322, such as rearward of the rear 308 of the housing 304. For example, the mounting portions 318 of the contacts 312 may extend from the rear chamber 322. In other various embodiments, the contact assembly 305 may be entirely contained within the housing 304 (for example, the housing 304 may enclose the contact assembly 305 rather than having the contact assembly 305 extend behind the housing 304).

In an exemplary embodiment, the housing 304 includes a mounting flange 328 used for mounting the connector 300 to another structure, such as a panel or a chassis of a component. Optionally, the housing 304 may be a multi-piece structure.

In an exemplary embodiment, the contact holder 310 is a multi-piece structure. For example, the contact holder 310 may include a front shell 330 and a rear holder 332. The front shell 330 and the rear holder 332 may be manufactured from dielectric materials to provide electrical insulation between the contacts 312. Alternatively, the front shell 330 and/or the rear holder 332 may be metal and may hold an insulator therein. The front shell 330 may be secured to the rear holder 332 using adhesive, epoxy, mechanical fasteners, friction or other means. Providing multi-piece structures allows for different types of assembly of the circuit board connector 300, such as the use of multi-piece contacts 312. For example, the multi-piece structures may allow assembly of the mating portions 316 in the housing 304, assembly of the mounting portions 318 in the rear holder 332 and then assembly of the rear holder 322 and the corresponding mounting portions 318 to the front shell 330 and the corresponding mating portions 316 as a unit.

In an exemplary embodiment, the contact assembly 305 includes contact modules 334 that include corresponding mounting portions 318, arranged in contact sets 335. The contact modules 334 may be overmolded leadframes. The contact modules 334 hold the contact sets 335 separate from each other. The contact modules 334 may be individually loaded into the rear holder 332, such that the mounting portions 318 are loaded into the rear holder 332 together as the contact set 335. In an exemplary embodiment, the contacts 312 are multi-piece contacts including a mating terminal 336 at the front 306 and a mounting terminal 338 at the rear 308. The mating terminal 336 defines the mating portion 316. The mounting terminal 338 defines the mounting portion 318. The mounting terminals 338 are discrete from the mating terminals 336 and are mechanically and electrically connected to the corresponding mating terminals 336 within the housing 304.

Each mating terminal 336 includes a barrel-shaped base or connecting socket 340 at a rear 342 of the mating terminal 336. The connecting socket 340 is configured to receive a portion of the mounting terminal 338. In an exemplary embodiment, the mating terminals 336 are stamped and formed into the barrel shape. However, the mating terminals 336 may be machined or manufactured by other processes in alternative embodiments. When stamped and formed, the mating terminals 336 are wrapped around to include a seam extending the length of the mating terminals 336 between the rear 342 and the front 344 opposite the rear 342. For example, the mating terminal 336 may be stamped and formed into the barrel shape from a sheet of material having a first thickness. The thickness of the mating terminal 336 may be different than the thickness of the mounting terminal 338.

The front shell 330 extends between a front 350 and a rear 352. The front shell 330 includes a flange 354 between the front 350 and the rear 352. The flange 354 may be used to position the contact assembly 305 in the housing 304. For example, front shell 330 may be rear loaded into the housing 304 until the flange 354 abuts against the separating wall 324 with the front 350 of the front shell 330 passing through the opening 326 into the front chamber 320. The front shell 330 positions the fronts 344 of the mating terminals 336 in the front chamber 320 for mating with the mating connector 100.

The rear holder 332 extends between a front 370 and a rear 372. The front 370 may abut against or be receive in the front shell 330. The rear holder 332 includes portions of the contact channels 314 that hold the mounting terminals 338. The mounting terminals 338 are arranged at the front 370 for mating with the mating terminals 336 when the rear holder 332 is coupled to the front shell 330. The mounting terminals 338 extend from the rear 372 for mounting to the circuit board 302.

The mounting terminals 338 each extend between a front 380 and a rear 382. In an exemplary embodiment, the mounting terminal 338 includes a connecting pin 384 at the front 380 and a mounting pin 386 at the rear 382. The connecting pin 384 is compliant and configured for a press-fit mechanical and electrical connection to the mating terminal 336. For example, the connecting pin 384 may be received in the connecting socket 340. In the illustrated embodiment, the connecting pin 384 is an eye-of-the-needle pin configured to be plugged into the connecting socket 340 at the rear 342 of the mating terminal 336. The mounting pin 386 is compliant and configured for a press-fit mechanical and electrical connection to the circuit board 302. For example, the mounting pin 386 may be received in a plated via of the circuit board 302. In the illustrated embodiment, the mounting pin 386 is an eye-of-the-needle pin configured to be press-fit coupled to the circuit board 302. In an exemplary embodiment, the mounting terminal 338 is stamped and formed to include the eye-of-the-needle shaped connecting pin 384 at the front 380 and the eye-of-the-needle shaped mounting pin 386 at the rear 382. The pins 384, 386, in the illustrated embodiment, each include a compliant portion extending to a tip. The compliant portion includes opposing first and second legs surrounding an opening. The legs may be compressed inward into the opening when the pins 384, 386 are press-fit into the corresponding mounting structure. The legs may be spring biased outward against the mounting structure after the legs are deflected.

Figure 21:
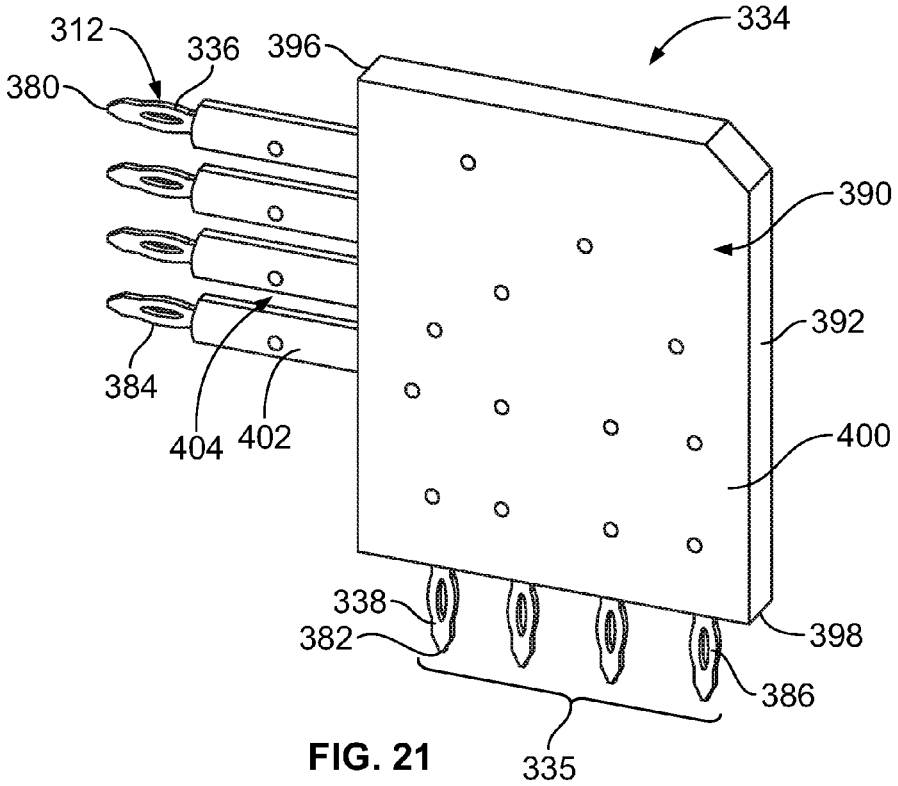
FIG. 21 is a side view of a contact module of the circuit board connector.
Figure 22:
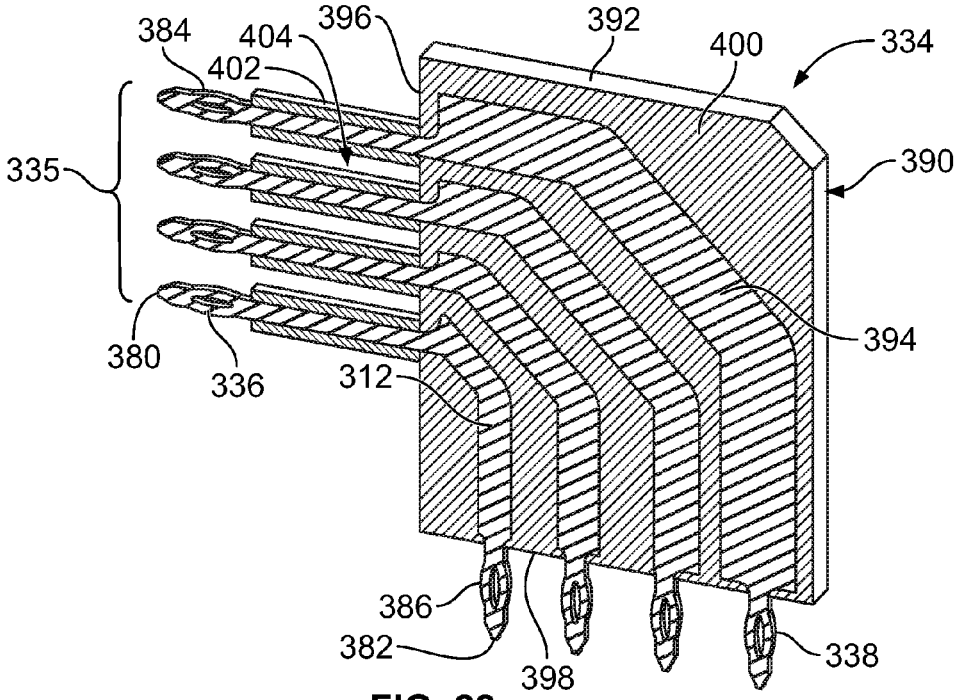
FIG. 22 is a partial sectional view of the contact module showing mounting terminals thereof.

FIG. 21 is a side view of the contact module 334 including the mounting terminals 338. FIG. 22 is a partial sectional view of the contact module 334 showing the mounting terminals 338. The mounting terminals 338 are arranged as part of the contact set 335. The mounting terminals 338 are held by an insulator 390. The insulator 390 electrically isolates the mounting terminals 338 from each other. The insulator 390 maintains positions/orientations of the mounting terminals 338 relative to each other, such as for mating with the mating terminals (shown in FIG. 20) and/or for mounting to the circuit board 302 (shown in FIG. 19). In an exemplary embodiment, the insulator 390 includes an overmolded body 392 molded over the mounting terminals 338. The overmolded body 392 encases the mounting terminals 338, such as transition portions 394 of the mounting terminals 338 between the connecting pins 384 and the corresponding mounting pins 386. In an exemplary embodiment, the transition portions 394 are right-angle transition portions transitioning approximately 90°.

The connecting pins 384 of the mounting terminals 338 extend from the insulator 390, such as for connection to the mating terminal 336. The mounting pins 386 of the mounting terminals 338 extend from the insulator 390 for connection to the circuit board 302. The connecting pins 384 are oriented generally perpendicular to the mounting pins 386. The transition portions 394 of the mounting terminals 338 transition in the insulator 390 such that the connecting pins 384 extend from a front 396 of the insulator 390 and the mounting pins 386 extend from a bottom 398 of the insulator 390. In an exemplary embodiment, the insulator 390 includes a main body 400 defining the front 396 and the bottom 398, as well as a top and a rear. The insulator 390 includes insulating sleeves 402 extending forward from the front 396. The insulating sleeves 402 surround portions of the connecting pins 384. The insulating sleeves 402 are separated by gaps 404. The insulating sleeves 402 provide support for the connecting pins 384, such as for press-fitting the connecting pins 384 into the connecting sockets 340 of the mating terminals 336.

Returning to FIG. 20, FIG. 20 illustrates the contact modules 334 received in the rear holder 332. The contact modules 334 are stacked vertically adjacent each other with the insulating sleeves 402 and corresponding connecting pins 384 extending into corresponding contact channels 314 of the rear holder 332. Portions of the rear holder 332 are positioned in the gaps 404 between the insulating sleeves 402. The rear holder 332 provides rigidity to the insulating sleeves 402, such as for press-fit mating to the connecting sockets 340 of the mating terminals 336.

Once assembled, the mating terminals 336 extend into the front chamber 320 of the housing 304 for electrical connection with the mating connector 100 in a mating direction along a mating axis 410 (for example, in a horizontal direction in the illustrated embodiment). The connecting pin 384 of the mounting terminal 338 is received in the connecting socket 340. The connecting pin 384 may be press-fit into the connecting socket 340, such as in a mating direction along the mating axis 410. The connecting pin 384 is compliant and configured for compliant mating with the mating terminal 336. The mounting terminal 338 transitions through the insulator 390 such that the mounting pin 386 is oriented perpendicular to the connecting pin 384. The mounting pin 386 is configured for press-fit mechanical and electrical connection to the circuit board 302 in a pressing direction along a pressing axis 412 generally perpendicular to the mating axis 410. As such, the contacts 312 are right-angle contacts allowing for perpendicular mating and mounting. The connector 300 is configured to be mounted to the circuit board 302 oriented parallel to the mating direction.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A press-fit circuit board connector comprising:

a housing having a front and a rear, the housing having a front chamber at the front configured to receive a mating connector, the housing having a rear chamber at the rear; and a contact assembly received in the rear chamber of the housing, the contact assembly having a contact holder including a plurality of contact channels and contacts received in corresponding contact channels, each contact having a mating terminal and a mounting terminal discrete from the corresponding mating terminal and mechanically and electrically connected to the corresponding mating terminal, the mating terminal extending between a front and a rear with the front extending into the front chamber of the housing for electrical connection with the mating connector in a mating direction along a mating axis, the mounting terminal extending between a front and a rear, the mounting terminal having a connecting pin at the front and having a mounting pin at the rear, the connecting pin of the mounting terminal being compliant and configured for compliant mating with the rear of the mating terminal, the mounting pin of the mounting terminal being compliant and configured for press-fit mechanical and electrical connection to a circuit board in a pressing direction along a pressing axis generally perpendicular to the mating axis, wherein the mounting terminals are arranged in contact sets, the mounting terminals of each contact set being held by a corresponding insulator separate from other contact sets, the insulator of each contact set being coupled to the contact holder, the connecting pin of the mounting terminal extending from the insulator for connection to the mating terminal and the mounting pin of the mounting terminal extending from the insulator for connection to the circuit board.

2. The circuit board connector of claim 1, wherein the mating terminal includes a barrel shaped connecting socket at the rear of the mating terminal receiving the connecting pin of the mounting terminal.

3. The circuit board connector of claim 1, wherein the mating terminal includes a barrel shaped mating socket at the front of the mating terminal for receiving pin contacts of the mating connector.

4. The circuit board connector of claim 1, wherein the insulator includes an overmolded body molded around the mounting terminals of the contact set to encase the mounting terminals.

5. The circuit board connector of claim 1, wherein each mounting terminal transitions in the insulator such that the connecting pin is oriented generally perpendicular to the mounting pin.

6. The circuit board connector of claim 1, wherein the mounting terminals transition in the insulator such that the connecting pins extend from a front of the insulator and the mounting pins extend from a bottom of the insulator.

7. The circuit board connector of claim 1, wherein the mating terminal is stamped and formed into a barrel shaped mating terminal having a seam extending the length of the mating terminal, the mounting terminal being stamped and formed to include an eye-of-the-needle shaped connecting pin at the front, the mating terminal being oriented in the contact channel such that the seam is offset approximately 90° relative to the eye-of-the-needle shaped connecting pin.

8. The circuit board connector of claim 1, wherein the housing includes a front shell and a rear holder discrete from the front shell, the front shell holding the mating terminals, the rear holder holding the mounting terminals, the front shell and the rear holder being at least partially received the rear chamber of the housing.

9. A press-fit circuit board connector comprising:

a housing having a front and a rear, the housing having a front chamber at the front configured to receive a mating connector, the housing having a rear chamber at the rear; and a contact assembly received in the rear chamber of the housing, the contact assembly having a contact holder including a plurality of contact channels and contacts received in corresponding contact channels, each contact having a mating terminal and a mounting terminal discrete from the corresponding mating terminal and mechanically and electrically connected to the corresponding mating terminal, the mating terminal extending between a front and a rear and having a mating socket at the front extending into the front chamber of the housing for electrical connection with the mating connector, the mounting terminal extending between a front and a rear, the mounting terminal having a connecting pin at the front and having a mounting pin at the rear, the connecting pin of the mounting terminal being compliant and configured for compliant mating with the rear of the mating terminal, the mounting pin of the mounting terminal being compliant and configured for press-fit mechanical and electrical connection to a circuit board, wherein the mounting terminals are arranged in contact sets, the mounting terminals of each contact set being held by a corresponding insulator separate from other contact sets, the insulator of each contact set being coupled to the contact holder, the connecting pins of the mounting terminals extending from the insulator for connection to the corresponding mating terminals and the mounting pins of the mounting terminals extending from the insulator for connection to the circuit board.

10. The circuit board connector of claim 9, wherein the mating socket is oriented in the front chamber for mating with the mating connector in a mating direction along a mating axis, the mounting pin of the mounting terminal being press-fit to the circuit board in a pressing direction along a pressing axis generally perpendicular to the mating axis.

11. The circuit board connector of claim 9, wherein the mating terminal includes a barrel shaped connecting socket at the rear of the mating terminal receiving the connecting pin of the corresponding mounting terminal.

12. The circuit board connector of claim 9, wherein the mating socket is barrel shaped for receiving a pin contact of the mating connector.

13. The circuit board connector of claim 9, wherein the insulator includes an overmolded body molded around the mounting terminals of the contact set to encase the mounting terminals.

14. The circuit board connector of claim 9, wherein each mounting terminal transitions in the insulator such that the connecting pin is oriented generally perpendicular to the mounting pin.

15. The circuit board connector of claim 9, wherein the mounting terminals transition in the insulator such that the connecting pins extend from a front of the insulator and the mounting pins extend from a bottom of the insulator.

16. A press-fit circuit board connector comprising:

a housing having a front and a rear, the housing having a front chamber at the front configured to receive a mating connector, the housing having a rear chamber at the rear; and a contact assembly received in the rear chamber of the housing, the contact assembly having a contact holder including a plurality of contact channels and contacts received in corresponding contact channels, each contact having a mating terminal and a mounting terminal discrete from the corresponding mating terminal and mechanically and electrically connected to the corresponding mating terminal;

the mating terminal extending between a front and a rear, the front of the mating terminal extending into the front chamber of the housing for electrical connection with the mating connector, the mating terminal having a connecting socket at the rear;

the mounting terminals being arranged in contact sets, the mounting terminals of each contact set being held by a corresponding insulator separate from other contact sets, the insulator of each contact set being coupled to the contact holder, each mounting terminal extending between a front and a rear, the mounting terminal having a connecting pin at the front extending from the insulator and having a mounting pin at the rear extending from the insulator, the connecting pin of the mounting terminal being compliant and configured for compliant mating with the rear of the mating terminal, the mounting pin of the mounting terminal being compliant and configured for press-fit mechanical and electrical connection to a circuit board.

17. The circuit board connector of claim 16, wherein the mating socket is oriented in the front chamber for mating with the mating connector in a mating direction along a mating axis, the mounting pin of the mounting terminal being press-fit to the circuit board in a pressing direction along a pressing axis generally perpendicular to the mating axis.

18. The circuit board connector of claim 16, wherein each mounting terminal transitions in the insulator such that the connecting pin is oriented generally perpendicular to the mounting pin.

* * * * *